US010424248B2

(12) United States Patent
Ko et al.

(10) Patent No.: US 10,424,248 B2
(45) Date of Patent: Sep. 24, 2019

(54) DISPLAY PANEL AND DISPLAY DEVICE

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Young Yik Ko, Beijing (CN); Wanli Dong, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan (CN)

( * ) Notice: Subject to any disclaimer, the term of this patent is extended or adjusted under 35 U.S.C. 154(b) by 43 days.

(21) Appl. No.: 15/566,071

(22) PCT Filed: May 5, 2017

(86) PCT No.: PCT/CN2017/083123

§ 371 (c)(1),
(2) Date: Oct. 12, 2017

(87) PCT Pub. No.: WO2018/072429

PCT Pub. Date: Apr. 26, 2018

(65) Prior Publication Data

US 2018/0330664 A1 Nov. 15, 2018

(30) Foreign Application Priority Data

Oct. 21, 2016 (CN) ..... 2016 1 0921692

(51) Int. Cl.

| | |
|---|---|
| ***G09G 3/3258*** | (2016.01) |
| ***G09G 3/3266*** | (2016.01) |
| ***G09G 3/3208*** | (2016.01) |

(52) U.S. Cl.
CPC ..... *G09G 3/3258* (2013.01); *G09G 3/3208* (2013.01); *G09G 3/3266* (2013.01);
(Continued)

(58) Field of Classification Search
CPC ..... G09G 3/3258; G09G 3/3266; G09G 2300/0426; G09G 2320/0223
See application file for complete search history.

(56) References Cited

U.S. PATENT DOCUMENTS

| | | | | |
|---|---|---|---|---|
| 9,934,722 | B2 * | 4/2018 | Kim | G09G 3/3233 |
| 2006/0022969 | A1 * | 2/2006 | Lee | G02F 1/136286 345/211 |

(Continued)

FOREIGN PATENT DOCUMENTS

| | | | |
|---|---|---|---|
| CN | 1758311 | A | 4/2006 |
| CN | 104008722 | A | 8/2014 |

(Continued)

OTHER PUBLICATIONS

The First Chinese Office Action dated May 21, 2018; Appln. No. 201610921692.2.

(Continued)

*Primary Examiner* — Ibrahim A Khan
(74) *Attorney, Agent, or Firm* — Ladas & Parry LLP

(57) ABSTRACT

A display panel and display device, the display panel includes: a first power terminal disposed on a first side of the display panel; a second power terminal disposed on a second side of the display panel; and a power line configured to transmit mains voltage, wherein the first side and the second side are arranged opposite to each other; and the first power terminal and the second power terminal is in one-to-one correspondence and configured to provide equal mains voltage for the power line. The display panel and display device can compensate the IR drop on a power line in the display (Continued)

panel and hence reduce or eliminate the problem of uneven display brightness of the display panel due to IR drop.

17 Claims, 3 Drawing Sheets

(52) U.S. Cl.
CPC ..... *G09G 2300/0408* (2013.01); *G09G 2320/0223* (2013.01); *G09G 2330/028* (2013.01)

(56) References Cited

U.S. PATENT DOCUMENTS

2006/0077144 A1 4/2006 Eom et al.
2009/0009441 A1 1/2009 Yamamoto et al.
2009/0045733 A1* 2/2009 Suh ..... H01L 27/3276 313/504
2009/0184626 A1* 7/2009 Kim ..... G09G 3/3208 313/504
2009/0278835 A1* 11/2009 Ka ..... G09G 3/006 345/211
2011/0291115 A1* 12/2011 Kim ..... G09G 3/3225 257/88
2012/0044221 A1* 2/2012 Ko ..... H01L 27/3276 345/205
2014/0091992 A1* 4/2014 Lee ..... G09G 3/3233 345/77
2014/0232275 A1 8/2014 Kwon et al.
2015/0171155 A1 6/2015 Yun et al.
2015/0255017 A1 9/2015 Kim
2015/0294612 A1* 10/2015 Kim ..... G09G 3/3225 345/690
2016/0086542 A1* 3/2016 Lee ..... G09G 3/2022 345/212
2016/0133189 A1* 5/2016 Kang ..... G09G 3/3258 345/211
2016/0260383 A1* 9/2016 Shin ..... G09G 3/3258
2016/0343304 A1* 11/2016 Hwang ..... G09G 3/3258
2016/0358545 A1 12/2016 Yin et al.
2017/0194593 A1 7/2017 Ma et al.

FOREIGN PATENT DOCUMENTS

CN 104050915 A 9/2014
CN 104409046 A 3/2015
CN 104733640 A 6/2015
CN 104900673 A 9/2015
CN 105679795 A 6/2016
CN 106448562 A 2/2017
CN 206097868 U 4/2017
EP 1612766 A1 1/2006
KR 1020060031550 A 4/2006

OTHER PUBLICATIONS

International Search Report and Written Opinion dated Jul. 26, 2017; PCT/CN2017/083123.

* cited by examiner

DISPLAY PANEL AND DISPLAY DEVICE

TECHNICAL FIELD

Embodiments of the present invention relate to a display panel and a display device.

BACKGROUND

In the display field, organic light-emitting diode (OLED) display panels have the characteristics of autoluminescence, high contrast, low energy consumption, wide viewing angle, rapid response speed, capability of being applied to flexible panels, wide service temperature range, simple production and the like, and have a broad development prospect.

The phenomenon of IR drop will be produced in the OLED display panel. IR drop is caused by resistance voltage division of leads in the display panel. That is to say, when current runs through the leads in the display panel, certain voltage drop will be produced on the leads according to Ohm's law. Therefore, the degree of pixel units, disposed at different positions, being affected by IR drop is also different, so the display panel will have the problem of display unevenness. Thus, the IR drop in the OLED display panel must be compensated.

SUMMARY

According to embodiments of this disclosure, a display panel is provided, comprising: a first power terminal disposed on a first side of the display panel; a second power terminal disposed on a second side of the display panel; and a power line configured to transmit mains voltage, wherein the first side and the second side are arranged opposite to each other; and the first power terminal and the second power terminal is in one-to-one correspondence and configured to provide equal mains voltage for the power line.

For example, in the display panel provided in the embodiments of this disclosure, a first end of the power line is electrically connected with the first power terminal, and a second end of the power line is electrically connected with the second power terminal.

For example, in the display panel provided in the embodiments of this disclosure, the power line is set to be perpendicular to at least one of the first side or the second side.

For example, in the display panel provided in the embodiments of this disclosure, further comprising a plurality of subpixels arranged in an array, wherein the subpixels are electrically connected with the power line to receive the mains voltage.

For example, in the display panel provided in the embodiments of this disclosure, the subpixel includes an organic light-emitting diode (OLED) and a drive circuit for driving the OLED to emit light; and the power line is electrically connected with the drive circuit to provide the mains voltage for the drive circuit.

For example, in the display panel provided in the embodiments of this disclosure, further comprising: a plurality of data lines and a plurality of scanning signal lines which are intersected with each other; a data driver; and a scanning signal driver, wherein the data driver is configured to provide luminous data of the OLED to the drive circuit through the data line, so as to drive the OLED to emit light in the working process; and the scanning signal driver is configured to provide a scanning control signal for the drive circuit through the scanning signal line.

For example, in the display panel provided in the embodiments of this disclosure, further comprising a transfer power terminal and a transfer cable, wherein the transfer power terminal is disposed on the first side of the display panel and electrically connected with the second power terminal through the transfer cable.

For example, in the display panel provided in the embodiments of this disclosure, the transfer power terminal is configured to provide intermediate voltage; and the intermediate voltage is equal to the sum of the mains voltage and the intermediate voltage drop on the transfer cable.

For example, in the display panel provided in the embodiments of this disclosure, further comprising a first power supply lead wire and a second power supply lead wire, wherein a first end of the first power supply lead wire is electrically connected with the first power terminal, and a first end of the second power supply lead wire is electrically connected with the transfer power terminal.

For example, in the display panel provided in the embodiments of this disclosure, further comprising a first power supply circuit, wherein the first power supply circuit includes a first power supply terminal and a second power supply terminal; the first power supply terminal is configured to provide first power supply voltage; the second power supply terminal is configured to provide second power supply voltage; the first power supply terminal is electrically connected with a second end of the first power supply lead wire; and the second power supply terminal is electrically connected with a second end of the second power supply lead wire.

For example, in the display panel provided in the embodiments of this disclosure, the first power supply voltage is equal to the sum of the mains voltage and first lead voltage drop on the first power supply lead wire; and the second power supply voltage is equal to the sum of the intermediate voltage and second lead voltage drop on the second power supply lead wire.

For example, in the display panel provided in the embodiments of this disclosure, further comprising a third power supply lead wire and a fourth power supply lead wire, wherein a first end of the third power supply lead wire is electrically connected with the first power terminal, and a first end of the fourth power supply lead wire is electrically connected with the second power terminal.

For example, in the display panel provided in the embodiments of this disclosure, further comprising a second power supply circuit wherein the second power supply circuit includes a third power supply terminal and a fourth power supply terminal; the third power supply terminal is configured to provide third power supply voltage; the fourth power supply terminal is configured to provide fourth power supply voltage; the third power supply terminal is electrically connected with a second end of the third power supply lead wire; and the fourth power supply terminal is electrically connected with a second end of the fourth power supply lead wire.

For example, in the display panel provided in the embodiments of this disclosure, the third power supply voltage is equal to the sum of the mains voltage and third lead voltage drop on the third power supply lead wire; and the fourth power supply voltage is equal to the sum of the mains voltage and fourth lead voltage drop on the fourth power supply lead wire.

According the embodiments of this disclosure, a display device is further provided, comprising the display panel.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. In addition, in each embodiment of this disclosure, same or similar reference signs indicate same or similar components.

In an OLED display panel, due to the resistance voltage division of a power lines, the power line will have the phenomenon of IR drop, namely certain voltage drop will be produced when current runs through the power line in the display panel. Therefore, the impact degree of pixel units, disposed at different positions, by IR drop will also be different. For instance, the mains voltage received by pixel units at near ends (close to a power supply circuit or leads of a power supply source) of the display panel will be greater than the mains voltage received by pixel units at far ends (far away from the power supply circuit) of the display panel, resulting in uneven display brightness of the display panel. Therefore, the IR drop in the OLED display panel must be compensated to solve the problem of uneven display brightness of the display panel.

Embodiments of the present invention provide a display panel and a display device, which can compensate the IR drop on a power line in the display panel and hence reduce or eliminate the problem of uneven display brightness of the display panel due to IR drop.

First Embodiment

Figure 1:
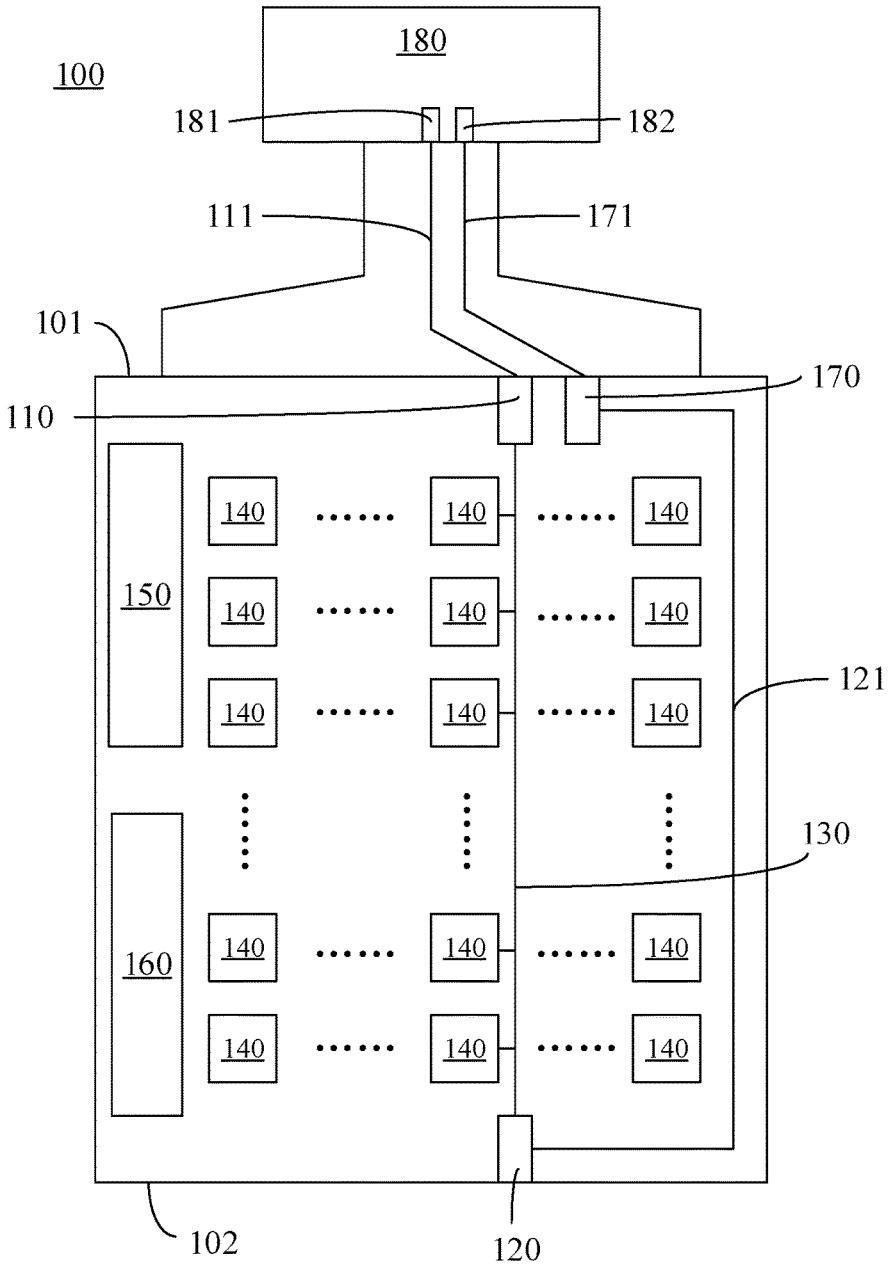
FIG. 1 is a schematic diagram 1 of a display panel provided by the embodiment of the present invention.

The embodiment of the present invention provides a display panel 100. As illustrated in FIG. 1, the display panel 100 comprises: a first power terminal 110 disposed on a first side 101 of the display panel 100; a second power terminal 120 disposed on a second side 102 of the display panel 100; and a power line 130 configured to transmit mains voltage VDD. The first side 101 and the second side 102 are arranged opposite to each other. The first power terminal 110 and the second power terminal 120 are in one-to-one correspondence and configured to provide equal mains voltage VDD for the power line 130.

For instance, as for a rectangular display panel, the first side and the second side may be upper and lower sides or left and right sides arranged opposite to each other.

For instance, in the display panel 100 provided by the embodiment of the present invention, a first end of the power line 130 is electrically connected with the first power terminal 110, and a second end of the power line 130 is electrically connected with the second power terminal 120.

For instance, in the display panel 100 provided by the embodiment of the present invention, the power line 130 is set to be perpendicular to the first side 101 and/or the second side 102.

For instance, the display panel 100 provided by the embodiment of the present invention further comprises a plurality of subpixels arranged in an array. The subpixels 140 are electrically connected with the power line 130 to receive the mains voltage VDD.

Figure 2:
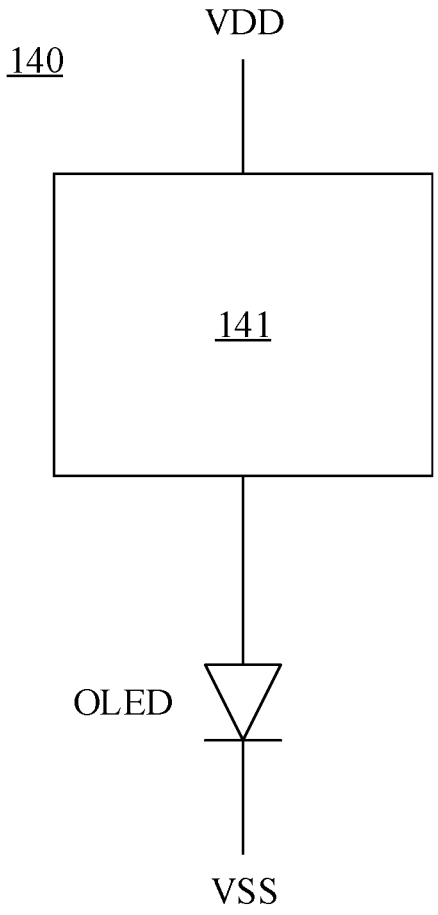
FIG. 2 is a schematic diagram of subpixels in the display panel provided by the embodiment of the present invention.

For instance, as shown in FIG. 2, in the display panel 100 provided by the embodiment of the present invention, the subpixel 140 includes an organic light-emitting diode OLED and a drive circuit 141 for driving the organic light-emitting diode OLED to emit light; and the power line 130 is electrically connected with the drive circuit 141 to provide the mains voltage VDD for the drive circuit 141.

For instance, the power line 130 may also be connected with a cathode of the organic light-emitting diode OLED to provide cathode mains voltage VSS for the organic light-emitting diode OLED. That is to say, the mains voltage provided by the first power terminal and the second power terminal in the display panel provided by the embodiment of the present invention is not limited to the mains voltage VDD and may also be other voltage affected by IR drop, for instance, the cathode mains voltage VSS of the organic light-emitting diode OLED or other reference voltage applied to the drive circuit.

For instance, as shown in FIG. 1, the display panel 100 provided by the embodiment of the present invention further comprises: a plurality of data lines and a plurality of scanning signal lines (not shown in the figure) which are intersected with each other; a data driver 150; and a scanning signal driver 160. The data driver 150 is configured to provide luminous data of the organic light-emitting diode OLED to the drive circuit 141 through the data line, so as to drive the organic light-emitting diode OLED to emit light in the working process. The scanning signal driver 160 is configured to provide a scanning control signal for the drive circuit 141 through the scanning signal line.

For instance, the display panel 100 provided by the embodiment of the present invention further comprises a transfer power terminal 170 and a transfer cable 121. The transfer power terminal 170 is disposed on the first side 101 of the display panel 100 and electrically connected with the second power terminal 120 through the transfer cable 121.

For instance, the transfer cable 121 may be formed on the display panel 100 in the same layer with the power line 130 by patterning process; or the transfer cable 121 may also be electrically connected with the transfer power terminal and the second power terminal through an external flexible circuit board or an external lead.

For instance, in the display panel 100 provided by the embodiment of the present invention, the transfer power terminal 170 is configured to provide intermediate voltage VC. The intermediate voltage VC is equal to the sum of the mains voltage VDD and intermediate voltage drop VDC on the transfer cable 121. That is to say, as there is intermediate voltage drop VDC on the transfer cable 121, the intermediate voltage required to be provided by the transfer power terminal 170 satisfiesVC=VDD+VDC when the second power terminal 120 is required to provide mains voltage VDD equal to that of the first power terminal 110.

For instance, the display panel 100 provided by the embodiment of the present invention further comprises a first power supply lead wire 111 and a second power supply lead wire 171. A first end of the first power supply lead wire 111 is electrically connected with the first power terminal 110, and a first end of the second power supply lead wire 171 is electrically connected with the transfer power terminal 170.

For instance, the first power supply lead wire 111 and the second power supply lead wire 171 may be disposed on the flexible circuit board.

For instance, the display panel 100 provided by the embodiment of the present invention further comprises a first power supply circuit 180. The first power supply circuit 180 includes a first power supply terminal 181 and a second power supply terminal 182; the first power supply terminal 181 is configured to provide first power supply voltage VS1; the second power supply terminal 182 is configured to provide second power supply voltage VS2; the first power supply terminal 181 is electrically connected with a second end of the first power supply lead wire 111; and the second power supply terminal 182 is electrically connected with a second end of the second power supply lead wire 171. That is to say, the first power supply circuit 180 supplies power for the first power supply terminal 110 through the first power supply terminal 181 and the first power supply lead wire 111, so that the voltage of the first power terminal 110 can be the mains voltage VDD; and the first power supply circuit 180 provides the intermediate voltage VC for the transfer power terminal 170 through the second power supply terminal 182 and the second power supply lead wire 171.

For instance, the first power supply circuit may be implemented by a power supply chip.

For instance, in the display panel 100 provided by the embodiment of the present invention, the first power supply voltage VS1 is equal to the sum of the mains voltage VDD and first lead voltage drop VD1 on the first power supply lead wire 111; and the second power supply voltage VS2 is equal to the sum of the intermediate voltage VC and second lead voltage drop VD2 on the second power supply lead wire 171. That is to say, as there is first lead voltage drop VD1 on the first power supply lead wire 111, the first power supply voltage required to be provided by the first power supply terminal 181 satisfies VS1=VDD+VD1 if the voltage of the first power terminal 110 is required to be the mains voltage VDD; and as there is second lead voltage drop VD2 on the second power supply lead wire 171, the second power supply voltage required to be provided by the second power supply terminal 182 satisfies VS2=VC+VD2 if the voltage of the transfer power terminal 170 is required to be the intermediate voltage VC.

Figure 3:
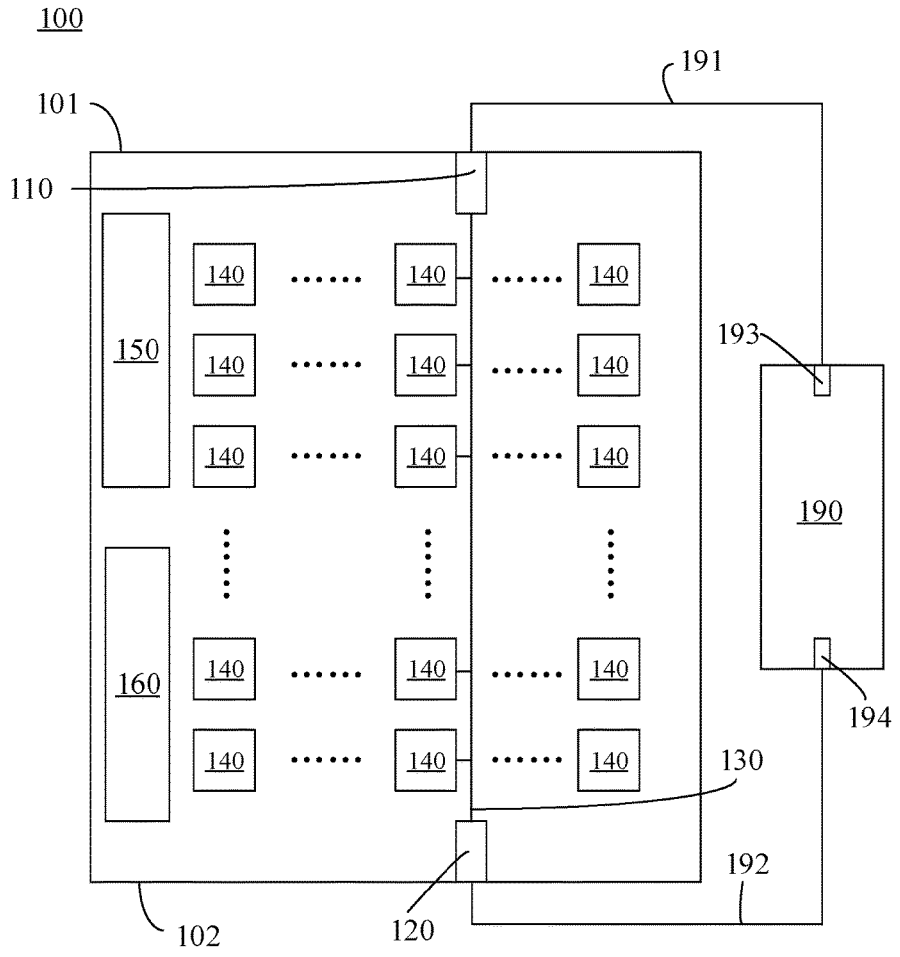
FIG. 3 is a schematic diagram 2 of a display panel provided by the embodiment of the present invention.

For instance, the first power supply voltage VS1 and the second power supply voltage VS2 may also be acquired by experiment means. For instance, the voltage of the first power terminal 110 and the voltage of the second power terminal 120 are simultaneously measured. The voltage of the first power terminal 110 and the voltage of the second power terminal 120 are both the mains voltage VDD by adjustment of the first power supply voltage VS1 and the second power supply voltage VS2 of the first power supply circuit 180. For instance, as shown in FIG. 3, the embodiment of the present invention further provides a display panel 100, which comprises: a first power terminal 110 disposed on a first side 101 of the display panel 100; and a second power terminal 120 disposed on a second side 102 of the display panel 100. The first side 101 and the second side 102 are arranged opposite to each other. The first power terminal 110 and the second power terminal 120 are in one-to-one correspondence and configured to provide equal mains voltage VDD.

For instance, the first power terminal 110 and the second power terminal 120 may be strip power terminals. One first power terminal 110 and one second power terminal 120 in one-to-one correspondence may be electrically connected with a plurality of power lines 130 to provide mains voltage for the plurality of power lines 130.

For instance, the display panel 100 provided by the embodiment of the present invention may comprise a plurality of first power terminals 110, a plurality of second power terminals 120 and a plurality of power lines 130. For instance, each power line may correspond to one first power terminal 110 and one second power terminal 120. Each power line is configured to provide mains voltage for one row or one column of subpixels.

For instance, the display panel 100 may comprise a plurality of first power supply lead wires and/or a plurality of second power supply lead wires.

For instance, one transfer power terminal 170 may be electrically connected with the plurality of second power terminals 120, and provides mains voltage for the plurality of second power terminals 120 through a plurality of transfer cables 121.

For instance, the display panel 100 may further comprise a plurality of power supply circuits. The plurality of power supply circuits supply power for the first power terminals and the transfer power terminals through corresponding power supply lead wires respectively.

For instance, the embodiment of the present invention includes but not limited to the above examples. The arrangement means and the number of the terminals, the power lines, the cables and the leads may be flexibly selected according to actual situation.

Second Embodiment

The embodiment of the present invention provides a display panel 100. As illustrated in FIG. 3, the display panel 100 comprises: a first power terminal 110 disposed on a first side 101 of the display panel 100; a second power terminal 120 disposed on a second side 102 of the display panel 100; and a power line 130 configured to transmit mains voltage VDD. The first side 101 and the second side 102 are arranged opposite to each other. The first power terminal 110 and the second power terminal 120 are in one-to-one correspondence and configured to provide equal mains voltage VDD for the power line 130.

For instance, as for a rectangular display panel, the first side and the second side may be upper and lower sides or left and right sides arranged opposite to each other.

For instance, in the display panel 100 provided by the embodiment of the present invention, a first end of the power line 130 is electrically connected with the first power terminal 110, and a second end of the power line 130 is electrically connected with the second power terminal 120.

For instance, in the display panel 100 provided by the embodiment of the present invention, the power line 130 is set to be perpendicular to the first side 101 and/or the second side 102.

For instance, the display panel 100 provided by the embodiment of the present invention further comprises a plurality of subpixels arranged in an array. The subpixels 140 are electrically connected with the power line 130 to receive the mains voltage VDD.

For instance, as shown in FIG. 2, in the display panel 100 provided by the embodiment of the present invention, the subpixel 140 includes an organic light-emitting diode OLED and a drive circuit 141 for driving the organic light-emitting diode OLED to emit light; and the power line 130 is electrically connected with the drive circuit 141 to provide the mains voltage VDD for the drive circuit 141.

For instance, the power line 130 may also be connected with a cathode of the organic light-emitting diode OLED to provide cathode mains voltage VSS for the organic light-emitting diode OLED. That is to say, the mains voltage provided by the first power terminal and the second power terminal in the display panel provided by the embodiment of the present invention is not limited to the mains voltage VDD and may also be other voltage affected by IR drop, for instance, the cathode mains voltage VSS of the organic light-emitting diode OLED or other reference voltage applied to the drive circuit.

For instance, as shown in FIG. 3, the display panel 100 provided by the embodiment of the present invention further comprises: a plurality of data lines and a plurality of scanning signal lines (not shown in the figure) which are intersected with each other; a data driver 150; and a scanning signal driver 160. The data driver 150 is configured to provide luminous data of the organic light-emitting diode OLED to the drive circuit 141 through the data line, so as to drive the organic light-emitting diode OLED to emit light in the working process. The scanning signal driver 160 is configured to provide a scanning control signal for the drive circuit 141 through the scanning signal line.

For instance, the display panel 100 provided by the embodiment of the present invention further comprises a third power supply lead wire 191 and a fourth power supply lead wire 192. A first end of the third power supply lead wire 191 is electrically connected with the first power terminal 110, and a first end of the fourth power supply lead wire 192 is electrically connected with the second power terminal 120.

For instance, the third power supply lead wire 191 and the fourth power supply lead wire 192 may be disposed on a flexible circuit board.

For instance, the display panel 100 provided by the embodiment of the present invention further comprises a second power supply circuit 190. The second power supply circuit 190 includes a third power supply terminal 193 and a fourth power supply terminal 194; the third power supply terminal 193 is configured to provide third power supply voltage VS3; the fourth power supply terminal 194 is configured to provide fourth power supply voltage VS4; the third power supply terminal 193 is electrically connected with a second end of the third power supply lead wire 191; and the fourth power supply terminal 194 is electrically connected with a second end of the fourth power supply lead wire 192.

For instance, the second power supply circuit may be implemented by a power supply chip.

For instance, in the display panel 100 provided by the embodiment of the present invention, the third power supply voltage VS3 is equal to the sum of the mains voltage VDD and third lead voltage drop VD3 on the third power supply lead wire 191; and the fourth power supply voltage VS4 is equal to the sum of the mains voltage VDD and fourth lead voltage drop VD4 on the fourth power supply lead wire 192. That is to say, as there is third lead voltage drop VD3 on the third power supply lead wire 191, the third power supply voltage required to be provided by the third power supply terminal 193 satisfies VS3=VDD+VD3 if the voltage of the first power terminal 110 is required to be the mains voltage VDD; and as there is fourth lead voltage drop VD4 on the fourth power supply lead wire 192, the fourth power supply voltage required to be provided by the fourth power supply terminal 194 satisfies VS4=VDD+VD4 if the voltage of the second power terminal 120 is required to be the mains voltage VDD.

For instance, the third power supply voltage VS3 and the fourth power supply voltage VS4 may also be acquired by experiment means. For instance, the voltage of the first power terminal 110 and the voltage of the second power terminal 120 are simultaneously measured. The voltage of the first power terminal 110 and the voltage of the second power terminal 120 are both the mains voltage VDD by adjustment of the third power supply voltage VS3 and the fourth power supply voltage VS4 of the second power supply circuit 190.

For instance, the first power terminal 110 and the second power terminal 120 may be strip power terminals. One first power terminal 110 and one second power terminal 120 in one-to-one correspondence may be electrically connected with a plurality of power lines 130 to provide mains voltage for the plurality of power lines 130.

For instance, the display panel 100 provided by the embodiment of the present invention may comprise a plurality of first power terminals 110, a plurality of second power terminals 120 and a plurality of power lines 130. For instance, each power line may correspond to one first power terminal 110 and one second power terminal 120. Each power line is configured to provide mains voltage for one row or one column of subpixels.

For instance, the display panel 100 may comprise a plurality of third power supply lead wires and/or a plurality of fourth power supply lead wires.

For instance, the display panel 100 may further comprise a plurality of power supply circuits. The plurality of power supply circuits supply power for the first power terminals and the second power terminals through corresponding power supply lead wires.

For instance, the embodiment of the present invention includes but not limited to the above examples. The arrangement means and the number of the terminals, the power lines, the cables and the leads may be flexibly selected according to actual situation.

Third Embodiment

Figure 4:
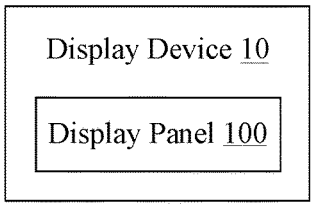
FIG. 4 is a schematic diagram of a display device provided by the embodiment of the present invention.

The embodiment of the present invention further provides a display device 10. As illustrated in FIG. 4, the display device 10 comprises the display panel 100 provided by any embodiment of the present invention.

For instance, the display device provided by the embodiment of the present invention may comprise any product or component with display function such as a mobile phone, a tablet PC, a TV, a display, a notebook computer, a digital picture frame and a navigator.

The display panel and the display device, provided by the embodiment of the present invention, can compensate the IR drop on the power line in the display panel and hence reduce or eliminate the problem of uneven display brightness of the display panel caused by IR drop.

The foregoing is only the preferred embodiments of the present invention and not intended to limit the scope of protection of the present invention. The scope of protection of the present invention should be defined by the appended claims.

The application claims priority to the Chinese patent application No. 201610921692.2, filed Oct. 21, 2016, the disclosure of which is incorporated herein by reference as part of the application.

The invention claimed is:

1. A display panel, comprising:

a first power terminal disposed on a first side of the display panel;

a second power terminal disposed on a second side of the display panel;

a power line configured to transmit mains voltage; wherein the first side and the second side are arranged opposite to each other; and the first power terminal and the second power terminal is in one-to-one correspondence and configured to provide equal mains voltage for the power line; and the display panel further comprises a transfer power terminal and a transfer cable, and the transfer power terminal is disposed on the first side of the display panel and electrically connected with the second power terminal through the transfer cable, and the transfer power terminal is not connected with the first power terminal.

2. The display panel according to claim 1, wherein a first end of the power line is electrically connected with the first power terminal, and a second end of the power line is electrically connected with the second power terminal.

3. A display device, comprising the display panel according to claim 2.

4. The display panel according to claim 1, wherein the power line is set to be perpendicular to at least one of the first side or the second side.

5. A display device, comprising the display panel according to claim 4.

6. The display panel according to claim 1, further comprising a plurality of subpixels arranged in an array, wherein the subpixels are electrically connected with the power line to receive the mains voltage.

7. A display device, comprising the display panel according to claim 6.

8. The display panel according to claim 6, wherein the subpixel includes an organic light-emitting diode (OLED) and a drive circuit for driving the OLED to emit light; and the power line is electrically connected with the drive circuit to provide the mains voltage for the drive circuit.

9. A display device, comprising the display panel according to claim 8.

10. The display panel according to claim 8, further comprising:

a plurality of data lines and a plurality of scanning signal lines which are intersected with each other;

a data driver; and a scanning signal driver, wherein the data driver is configured to provide luminous data of the OLED to the drive circuit through the data line, so as to drive the OLED to emit light in the working process; and the scanning signal driver is configured to provide a scanning control signal for the drive circuit through the scanning signal line.

11. A display device, comprising the display panel according to claim 10.

12. The display panel according to claim 1, wherein the transfer power terminal is configured to provide intermediate voltage; and the intermediate voltage is equal to the sum of the mains voltage and the intermediate voltage drop on the transfer cable.

13. The display panel according to claim 12, further comprising a first power supply lead wire and a second power supply lead wire, wherein a first end of the first power supply lead wire is electrically connected with the first power terminal, and a first end of the second power supply lead wire is electrically connected with the transfer power terminal.

14. The display panel according to claim 13, further comprising a first power supply circuit, wherein the first power supply circuit includes a first power supply terminal and a second power supply terminal; the first power supply terminal is configured to provide first power supply voltage; the second power supply terminal is configured to provide second power supply voltage; the first power supply terminal is electrically connected with a second end of the first power supply lead wire; and the second power supply terminal is electrically connected with a second end of the second power supply lead wire.

15. A display device, comprising the display panel according to claim 1.

16. A display panel, comprising:

a first power terminal disposed on a first side of the display panel;

a second power Ma disposed t n a second side of the display;

a power line configured to transmit main voltage;

a transfer power terminal and a transfer cable;

a first power supply lead wire and a second power supply lead wire; and a first power supply circuit, wherein the first side and the second side are arranged opposite to each other, the first power terminal and the second power terminal is in one-to-one correspondence and configured to provide equal mains voltage for the power line, the transfer power terminal is disposed on the first side of the display panel and electrically connected with the second power terminal through the transfer cable, the transfer power terminal is configured to provide intermediate voltage, the intermediate voltage is equal to the sum of the mains voltage and the intermediate voltage drop on the transfer cable, a first end of the first power supply lead wire is electrically connected with the first power terminal, a first end of the second power supply lead wire is electrically connected with the transfer power terminal, the first power supply circuit includes a first power supply terminal and a second power supply terminal, the first power supply terminal is configured to provide first power supply voltage, the second power supply terminal is configured to provide second power supply voltage, the first power supply terminal is electrically connected with a second end of the first power supply lead wire, the second power supply terminal is electrically connected with a second end of the second power supply lead wire, the first power supply voltage is equal to the sum of the mains voltage and first lead voltage drop on the first power supply lead wire, and the second power supply voltage is equal to the sum of the intermediate voltage and second lead voltage drop on the second power supply lead wire.

17. A display panel, comprising:

a first power terminal disposed on a first side of the display panel;

a second power terminal disposed on a second side of the display panel;

a power line configured to transmit mains voltage;

a third power supply lead wire and a fourth power supply lead wire; and a second power supply circuit, wherein the first side and the second side are arranged opposite to each other, and the first power terminal and the second power terminal is in one-to-one correspondence and configured to provide equal mains voltage for the power line, a first end of the third power supply lead wire is electrically connected with the first power terminal, and a first end of the fourth power supply lead wire is electrically connected with the second power terminal, the second power supply circuit includes a third power supply terminal and a fourth power supply terminal, the third power supply terminal is configured to provide third power supply voltage, the fourth power supply terminal is configured to provide fourth power supply voltage, the third power supply terminal is electrically connected with a second end of the third power supply lead wire, and the fourth power supply terminal is electrically connected with a second end of the fourth power supply lead wire, the third power supply voltage is equal to the sum of the mains voltage and third lead voltage drop on the third power supply lead wire, and the fourth power supply voltage is equal to the sum of the mains voltage and fourth lead voltage drop on the fourth power supply lead wire.

* * * * *